US005216785A

United States Patent [19]

Graef

[11] Patent Number: 5,216,785

[45] Date of Patent: Jun. 8, 1993

[54] TIE FASTENER

[75] Inventor: John Graef, Middleburg Heights, Ohio

[73] Assignee: Tie-Pro, Inc., Cleveland, Ohio

[21] Appl. No.: 895,950

[22] Filed: Jun. 9, 1992

[51] Int. Cl.[5] ..... A44B 6/00

[52] U.S. Cl. ..... 24/49 CF

[58] Field of Search ..... 24/49 R, 56, 49 CF, 24/50, 58, 659; 2/144, 145, 266

[56] References Cited

U.S. PATENT DOCUMENTS

| | | | |
|---|---|---|---|
| 1,100,923 | 6/1914 | Smith | 2/266 |
| 2,749,553 | 6/1956 | Miller . | |
| 3,042,983 | 7/1962 | Riedler . | |
| 3,151,371 | 10/1964 | Elkstad . | |
| 4,262,393 | 4/1981 | Neri . | |
| 4,827,576 | 5/1989 | Prince, Jr. . | |
| 4,835,821 | 6/1989 | Durante . | |
| 4,920,579 | 5/1990 | Swain . | |

*Primary Examiner*—James R. Brittain

*Attorney, Agent, or Firm*—Watts, Hoffmann, Fisher & Heinke

[57] ABSTRACT

A tie fastener for securing a necktie to a shirt is disclosed. The tie fastener includes three strips of flexible material joined together at one end. Each strip is identical to the others. An inner strip is buttoned to a shirt and an outer strip is fed through the loop-label of the tie. An intermediate strip is interposed between the inner and outer strips and serves to cover a shirt button and prevent the loop-label of the tie from catching on the button.

3 Claims, 1 Drawing Sheet

TIE FASTENER

BACKGROUND OF THE INVENTION

1. Field of the Invention

The present invention relates to tie fasteners, and more particularly, to tie fasteners for fastening neckties having label-loops to shirts having buttons.

2. Description of Related Art

In a windy conditions, unsecured neckties have a tendency to fly about. Also, they sometimes drape onto food and become an annoyance. Many devices have been developed to secure the free ends of neckties to a shirt. For example, tie clips and tie tacks are jewelry which, by gripping or piercing the tie, secure it to the shirt. However, these devices sometimes damage the tie and detract from its appearance.

Other tie fasteners have been developed which, while hidden from view, must be permanently attached to the tie. For example, U.S. Pat. No. 4,835,821 shows a tie fastener having a VELCRO strip which is bonded to the tie and a cooperating strip which is buttoned to the shirt. This device fails to provide for relative motion between the tie and the shirt which occurs for example when the wearer stands up or sits down.

U.S. Pat. No. 4,920,579 shows a loop of material which is permanently joined to the label-loop of a tie. This device provides inadequate room for relative motion between the tie and the shirt and it fails to provide adjustability for shirts having varying distances between adjacent buttons. That is, it will not fit all shirts.

There is a demand for a simple inexpensive tie fastener which is easily manufactured, requires to permanent affixation to the tie, and which adequately provides for various button spacings and for relative motion between the shirt and the tie.

SUMMARY OF THE INVENTION

The invention provides a necktie fastener for securing a necktie having a transverse loop-label on its back side to a shirt having a plurality of buttons. The tie fastener includes a first strip of material having a proximal and terminal ends and a pair of buttonholes formed therein, each buttonhole being adapted for connection to a corresponding one of the buttons. The tie fastener includes a second strip of material having proximal and terminal ends and at least one buttonhole formed therein for connection to one of the shirt buttons. The first and second strips are joined at their proximal ends and unattached and separable elsewhere along their respective lengths. The second strip is adapted to engage and retain the loop-label between the first and second strips when the strips are connected to the shirt by the buttons. The tie fastener preferably includes an intermediate strip having terminal and proximal ends. The intermediate strip is interposed between the first and second strips and joined at its proximal end to the proximal ends of the first and second strips.

BRIEF DESCRIPTION OF THE DRAWINGS

A preferred embodiment of the invention is shown in the accompanying drawings in which.

DESCRIPTION OF THE PREFERRED EMBODIMENT

Figure 1:
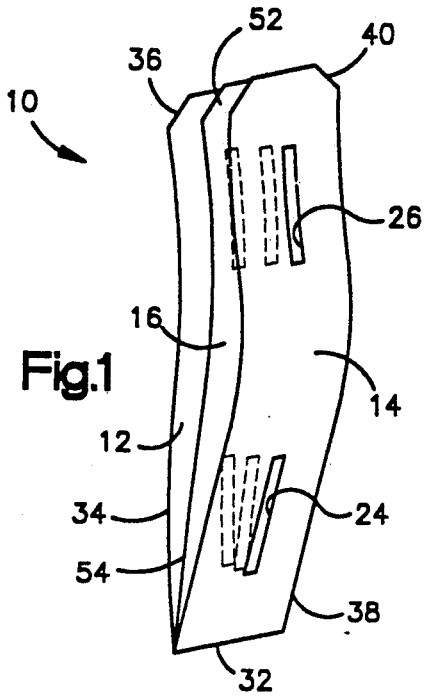
FIG. 1 is a perspective view of a tie fastener embodying the present invention.

Referring to FIG. 1, a tie fastener 10 embodying the present invention is shown. The tie fastener includes a first strip 12, a second strip 14, and an intermediate strip 16, all three strips 12,14,16 being identically sized. The strips are preferably made of transparent, flexible PVC material. Each strip 12,14,16 includes a pair of slots or buttonholes 20,22,24,26,28,30. The three strips joined together at one end with a heat seal 32, and are separable and unattached along the remainder of their lengths.

Figure 2:
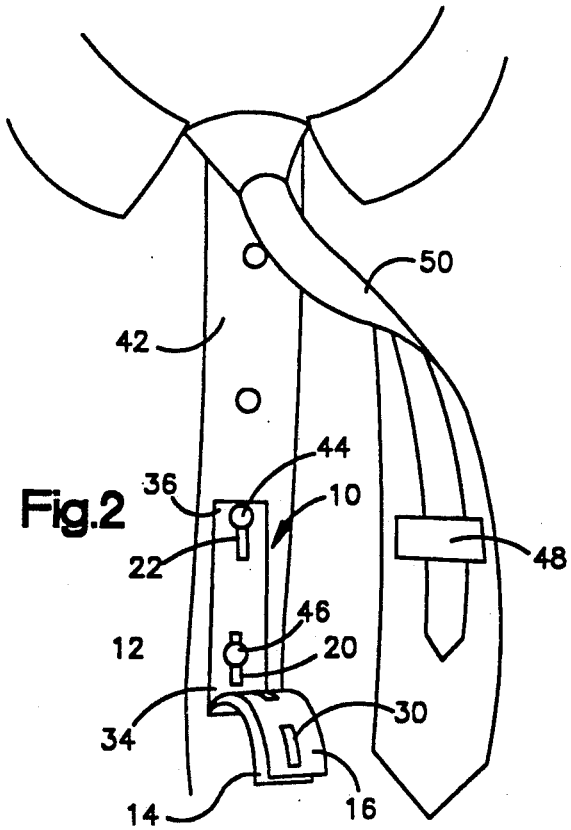
FIG. 2 is a perspective view of the tie fastener of FIG. 1 buttoned to a shirt.

Referring to FIG. 2, the first strip 12 is adapted to secure the tie holder to a shirt 42 when buttons 44,46 are buttoned to the buttonholes 20,22. The first strip 12 has a proximal end 34 and a distal end 36. One of the buttonholes 20,22 is located near each end. The proximal end 32 is heat sealed to the other strips 14, 16.

Figure 3:
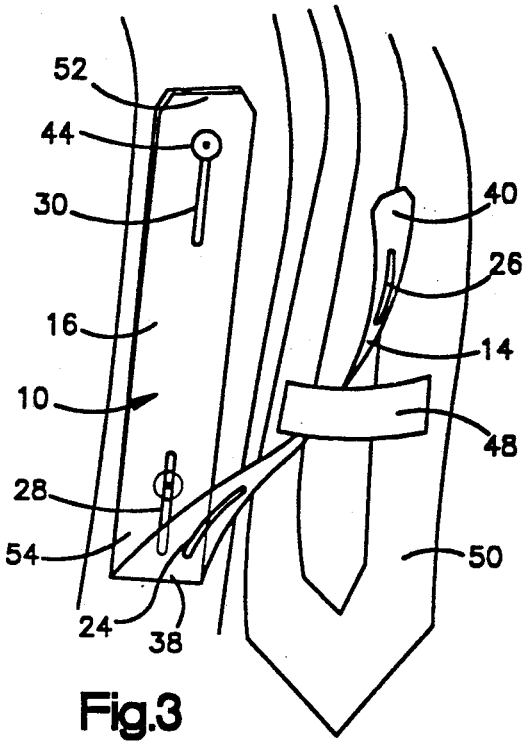
FIG. 3 is a perspective view of the tie fastener of FIG. 1 being attached to a tie.

Referring to FIG. 3, the second strip 14 serves to engage a loop-label 48 of a tie 50. The second strip 14 has a proximal end 38 and a distal end 40. The proximal end 38 is heat sealed to the proximal end 34 of the first strip 12. Near each end 38,40 one of the buttonholes 24,26 is located. The button holes 24,26 are in alignment with the buttonholes 20,22 of the first strip. The terminal end 40 of the second strip 14 is buttoned to the button 44 after being manually fed through the loop-label 48 of the tie 50 thus securing the tie 50 to the tie fastener 10 and the shirt 42.

The intermediate strip 16 is optional. That is, the tie fastener 'is operable without the intermediate strip. However, when only two strips are used, the edge of the loop-label 48 sometimes engages the button 46 when the tie 50 moves relative to the shirt 42 and thus causes the tie 50 to buckle. Without the intermediate strip 16, the freedom of movement of the tie 50 is thus restricted by the button 46. This is a significant problem with shirts having closely spaced buttons. The intermediate strip 16 serves to prevent the loop-label 48 from catching on the button 46 by covering it. Thus, with the intermediate strip 16, the loop-label 48 may move from the uppermost to the lowermost extent of the space between the second 14 and intermediate 16 strips regardless of the button spacing on the shirt 42. The intermediate strip 16 has a terminal end 52 and a proximal end 54 where it is heated sealed to the first and second strips 12,14. One of the buttonholes 28,30 is located near each end. The distal end 52 is buttoned to the button 44 with the buttonhole 30 along with the other distal ends 36,40.

The buttonholes are elongated to permit the tie fastener 10 to be used on shirts having varying distances between buttons. As shown in FIG. 3, the tie fastener 10 will work with shirts having buttons spaced much further or much closer apart. In the preferred embodiment, each buttonhole is 1.375 inches long and is spaced 1.69 inches from the other. The buttonholes 24 and 28 near the proximal ends of the second 14 and intermediate 16 strips are superfluous. It is more efficient from a manufacturing standpoint to punch buttonholes in all three strips than to selectively punch holes where they are needed. Thus, all the buttonholes 22,26,30 at the distal ends of the strips 12,14,16 are used and only one buttonhole 20 at the proximal ends of the strips 12,14,16 is used.

Figure 4:
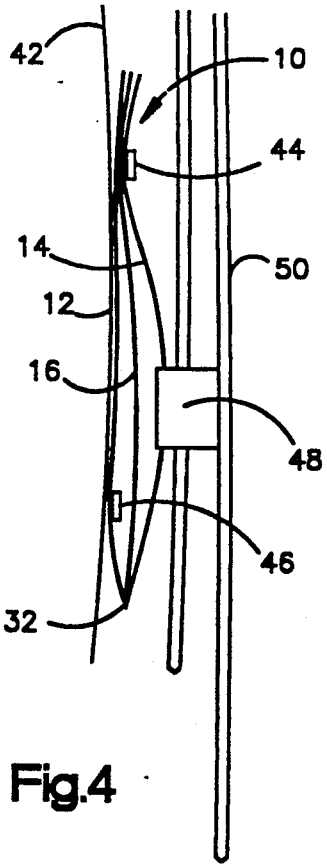
FIG. 4 is a side elevational view of the tie fastener of FIG. 1 attached to a shirt and a tie.

FIG. 4 shows the tie fastener 10 in use. While the tie fastener 10 is shown with the heat sealed end pointing downward, it may be used with the heat sealed end pointing upwards as well. In use, after tying his necktie 50, the wearer then looks for the position of the loop-label 48. The tie fastener 10 is then buttoned to two buttons 44,46 which lie above and below the loop-label 48. As shown in FIG. 2, both ends of the first strip 12 are buttoned to the shirt 42. Then, the terminal end 52 of the intermediate strip 16 is buttoned to the upper button 44. Next, as shown in FIG. 3, the second strip 14 is fed through the loop-label 48. The terminal end 40 of the second strip 14 is then buttoned to the upper button 44 to complete the attachment. The transparency of the tie fastener 10 makes it very difficult to see when in use. The tie 50 is removable from the tie fastener 10 by buttoning the second strip 14 and sliding it out of the loop-label 48.

While a preferred embodiment of this invention has been described in detail, it will be apparent that certain modifications or alterations can be made without departing from the spirit and scope of the invention set forth in the appended claims.

I claim:

1. A necktie fastener comprising:

a first strip of material having a proximal end and a distal end and a pair of buttonholes formed therein;

a second strip of material substantially identical to said first strip having a proximal end and a distal end and at least one buttonhole formed therein, said first and second strips being joined at their proximal ends;

an intermediate strip of material substantially identical to said first and second strips having a proximal end and a distal end interposed between said first and second strips and joined at its proximal end to the proximal ends of said first and second strips;

wherein said terminal ends are adapted to button to a shirt and the proximal end of said first strip is adapted to button to the shirt and wherein a necktie may be fastened to the shirt by capturing a loop-label of the necktie between said intermediate and second strips.

2. A necktie fastener comprising:

a first strip of material having a proximal end and a distal end and a pair of buttonholes formed therein, each buttonhole being adapted for connection to a corresponding shirt button;

a second strip of material having a proximal end and a distal end and at least one buttonhole formed therein for connection to a shirt button, said first and second strips being joined at their proximal ends and attached and separable elsewhere along their respective lengths wherein said second strip is adapted to engage and retain a neck-tie loop-label between said first and second strips when said strips are buttoned to a shirt; and a third strip of material having proximal and terminal ends and at least one buttonhole formed therein, said third strip being interposed between said first and second strips and joined at its proximal end to the proximal ends of said first and second strips.

3. A tie fastener according to claim 2 wherein said material is transparent.

* * * * *